US007033231B2

(12) United States Patent
Lu

(10) Patent No.: US 7,033,231 B2
(45) Date of Patent: Apr. 25, 2006

(54) RADIAL SCREW CONNECTING DEVICE FOR AN ELECTRICAL WIRE

(75) Inventor: Shan-Jui Lu, Xizhi (TW)

(73) Assignee: Lantek Electronics Inc., Xizhi (TW)

( * ) Notice: Subject to any disclaimer, the term of this patent is extended or adjusted under 35 U.S.C. 154(b) by 0 days.

(21) Appl. No.: 10/915,395

(22) Filed: Aug. 11, 2004

(65) Prior Publication Data

US 2006/0009087 A1 Jan. 12, 2006

(30) Foreign Application Priority Data

Jul. 8, 2004 (TW) ..... 93210793 U

(51) Int. Cl.
*H01R 4/36* (2006.01)

(52) U.S. Cl. ..... 439/812

(58) Field of Classification Search ..... 439/811, 439/812, 469, 472, 431, 810; 174/65 R
See application file for complete search history.

(56) References Cited

U.S. PATENT DOCUMENTS 3,683,414 A * 8/1972 DeAngelo et al. ..... 439/737
5,553,787 A * 9/1996 Guginsky ..... 439/472
6,339,190 B1 * 1/2002 Chung ..... 174/50

* cited by examiner

*Primary Examiner*—Phuong Dinh
(74) *Attorney, Agent, or Firm*—Troxell Law Office, PLLC

(57) ABSTRACT

A radial screw connecting device for an electrical wire includes a casing, a connecting seat, a press member and a bolt. The casing provides at least an opening for being extended with a joint. The connecting seat is disposed at and attached to a side of the casing and provides a lock hole and a receiving part. The press member is received in the receiving part and provides a pair of inner arms and an inner chamber. The bolt passes through the lock hole and provides a head, a first threaded part, an unthreaded part and a second threaded part with the second threaded part being engaged in the inner chamber. While in assembling, a ground wire is inserted into the receiving part below the press member and the ground wire can be fixed in the connecting seat and keeps contact with the connecting seat evenly by way of the bolt being turned and pressing a force against the press member and the press member can be lifted along with the bolt during the bolt being turned inversely.

19 Claims, 8 Drawing Sheets

RADIAL SCREW CONNECTING DEVICE FOR AN ELECTRICAL WIRE

BACKGROUND OF THE INVENTION

1. Field of the Invention

The present invention relates to a radial screw connecting device for an electrical wire and particularly to a radial screw connecting device for an electrical wire with a grounding seat and a press member with which a ground wire can be inserted under the press member and fixed in the grounding seat in a way of keeping contact with the grounding seat evenly by way of a bolt being turned to press against the press member with a force.

2. Description of Related Art

Usually, a certain amount of voltage is left in a coaxial cable distributor and in order to prevent signal from being interfered with the voltage and the engineering personnel from hazard of electric shock, a grounding device is provided to overcome possible harm to the signal and human body.

Referring to FIG. 6, a grounding device of the conventional distributor 60 provides a grounding seat 62 at a side of the distributor 60 and a screw thread hole is provided in the grounding seat 62 and a wire aperture 64 is disposed near lower end of the grounding seat 62. A ground wire 80 can be inserted into the grounding seat 62 via the wire aperture and a bolt 70 can press the ground wire 80 to join the ground wire 80 to the ground seat 62 of the distributor 60. However, the ground wire 80 becomes flattened due to being pressed with the bolt 70 and part of the cable lines of the ground wire 80 scatters around the lower end of the bolt 70 because of the lower end of the bolt 70 being not a flat surface. Under this circumstance, the effect of grounding for distributor is unfavorable.

Referring to FIG. 7, Taiwanese Utility Model Application No. 88221149, which is entitled "GROUNDING DEVICE OF ELECTRICAL SIGNAL DISTRIBUTOR" and has been granted, discloses a distributor 300 with a grounding seat 310 and the grounding seat 310 has a screw thread hole 320. A wire aperture 330 is further provided in the grounding seat 310 to pass through the grounding seat 310 along radial direction of the screw thread hole 320. A bolt 400, which engages with the screw thread hole 320, has a head 410 and a screw thread part 430 with a neck part 420 is disposed between the head 410 and the screw thread part 430. It is characterized in that a guide recess 340 is axially provided to surround the screw thread hole 320 and the press member 450 includes a clamp part 451 for clamping the neck part 420 of the bolt and a connecting rib 452 surrounding the clamp part 451 corresponding to the guide recess 340 with the length of the connecting rib 452 slightly longer than the screw thread part 430. Another end of the connecting rib 452 has a press part 453 with a holding groove 453 being formed in the press part 453 at the end side thereof opposite to the clamp part. The prior art has the disadvantages are: 1. It is necessary to be careful of the sense of the connecting rib 452 and the guide groove 330 so that it wastes more labor hour during assembling; 2. The holding groove 454 contacts the surface of the grounding wire only so that the contact area is too small and the grounding effect is unfavorable.

SUMMARY OF THE INVENTION

The crux of the present invention is to provide a radial screw connecting device for an electrical wire with a grounding seat and a press member with which a ground wire can be inserted under the press member and fixed in the grounding seat in a way of keeping contact with the grounding seat evenly by way of a bolt being turned to press against the press member with a force.

Accordingly, the radial screw connecting device for an electrical wire according to the present invention includes a casing, a connecting seat, a press member and a bolt. The casing provides at least an opening for being extended with a joint. The connecting seat is disposed at and attached to a side of the casing and provides a lock hole and a receiving part. The press member is received in the receiving part and provides a pair of inner arms and an inner chamber. The bolt passes through the lock hole and provides a head, a first threaded part, a hollow part and a second threaded part with the second threaded part being engaged in the inner chamber. While in assembling, a ground wire is inserted into the receiving part below the press member and the ground wire can be fixed in the connecting seat and keeps contact with the connecting seat evenly by way of the bolt being turned and pressing a force against the press member and the press member can be lifted along with the bolt during the bolt being turned inversely.

BRIEF DESCRIPTION OF THE DRAWINGS

The present invention can be more fully understood by reference to the following description and accompanying drawings, in which:

FIG. 3(*b*) is a rear perspective view illustrating the radial connecting device for wire screws in FIG. 2 being associated with a ground wire;

DETAILED DESCRIPTION OF THE PREFERRED EMBODIMENTS

Figure 1:
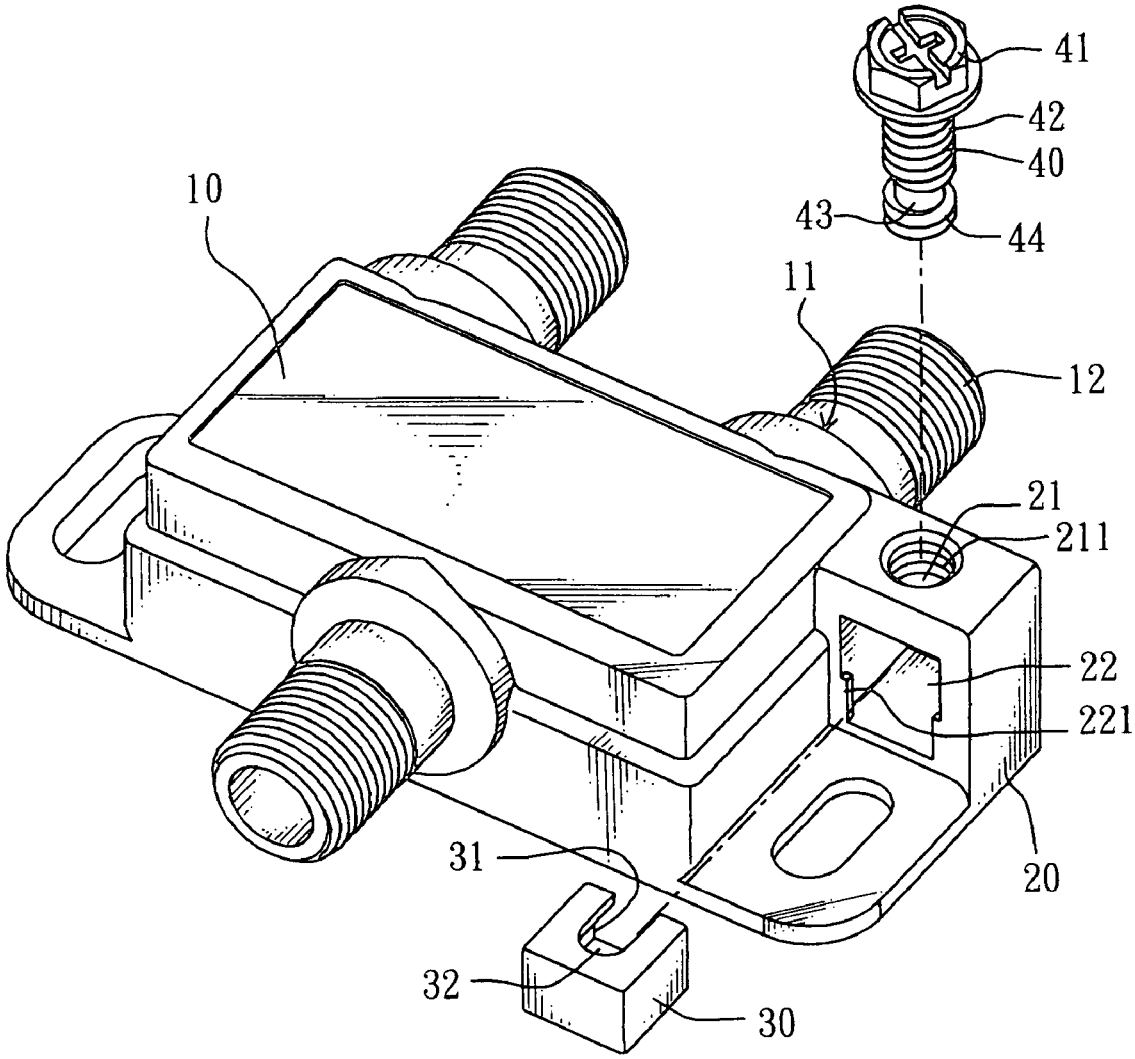
FIG. 1 is an exploded perspective view of a radial connecting device for wire screws according to the present invention in a first embodiment thereof.

Referring to FIG. 1, the radial screw connecting device for an electrical wire according to the present invention is a device in which screws are used to fixedly connect the electrical wire to a connection seat in a radial direction. The radial connecting device of the present invention can be applied to, for instance, a casing of electronic device in a distributor for eliminating voltage of the distributor possible hurt to signal and human body. The radial connecting device of the present invention includes a casing 10, a connecting seat 20, a press member 30 and a bolt 40.

wherein, the casing 10 at least has an opening 11 for a coaxial cable joint 12 being able to extending outward the casing 10. The connecting seat 20 is disposed at and connected to a lateral side of the casing 10 and the purpose of the connecting seat 20 is to ground voltage of the casing 10 via a ground wire so that it can be called as grounding seat. The connecting seat 20 has a lock hole 21 and a receiving part 22. The lock hole 21 is disposed at the top of the receiving part 22 with internal screw threads 211 for engaging with the bolt 40. The receiving part 22 has a space with a front and rear openings and a side of the receding part 22, for instance, the rear side thereof has at least a stop part 221 to limit and hold the press member 30 in the receiving part 22.

The press member 30, which can be received in the receiving part 22, has a pair of inner arms 31 and an inner chamber 32 with the pair of inner arms 31 extending upward and inward from two lateral sides of inner chamber 32 for receiving and holding the bolt 40.

The bolt 40 can pass through the lock hole 21 and enter the receiving part 22 and has a head 41, a first screw thread part 42, an unthreaded part 43 and a second screw thread part 44. The second screw thread part 44 can be engaged to the inner chamber 32.

Figure 2:
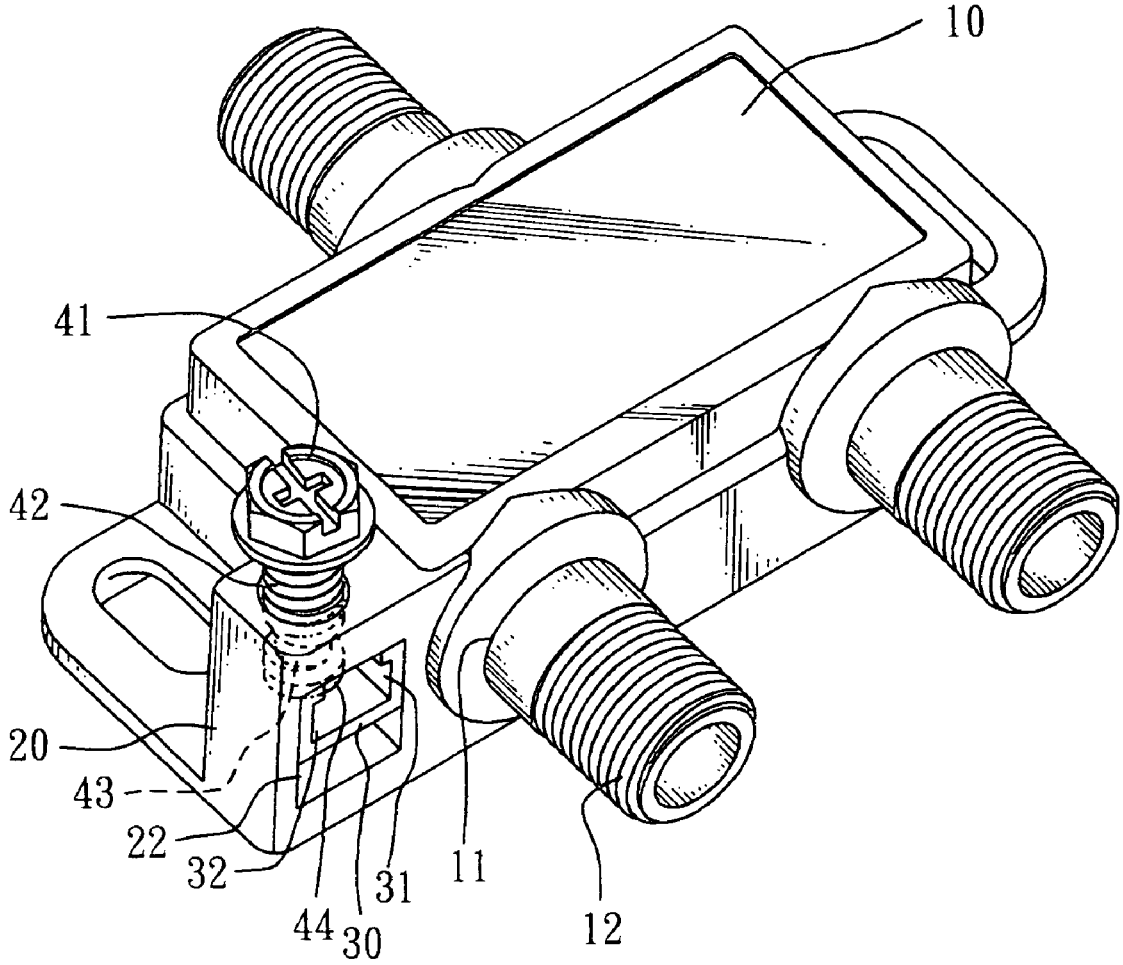
FIG. 2 is a perspective view of the radial connecting device for wire screws shown in FIG. 1.

Referring to FIG. 2, while the radial connecting device of electrical wire screws is to be fixed, the bolt 40 is threaded into the receiving part 22 downward vertically via the lock hole 21 and only the unthreaded part 43 and the second threaded part 44 expose in the receiving part 22. Then, the press member 30 passes through the rear side of the receiving part 22 transversely and enters the receiving part 22 and the second threaded part 44 is engaged to the inner chamber 32 till the tail end of the press member 30 entering the receiving part completely. Next, the ground wire 50 passes through the rear side of the press member 30 transversely and is disposed under the press member 30. The head 41 of the bolt 40 is turned continuously to move the bottom of the press member 30 downward gradually along the stop part 221 so as to press the ground wire 50 against the receiving part. Finally, the ground wire 50 can press against the receiving part 22 tightly. In this way, the ground wire 50 can be fixed in the connecting seat 20 firmly and contacts the connecting seat 20 evenly to avoid the deficiency of the grounding device of the conventional distributor.

Figure 3A:
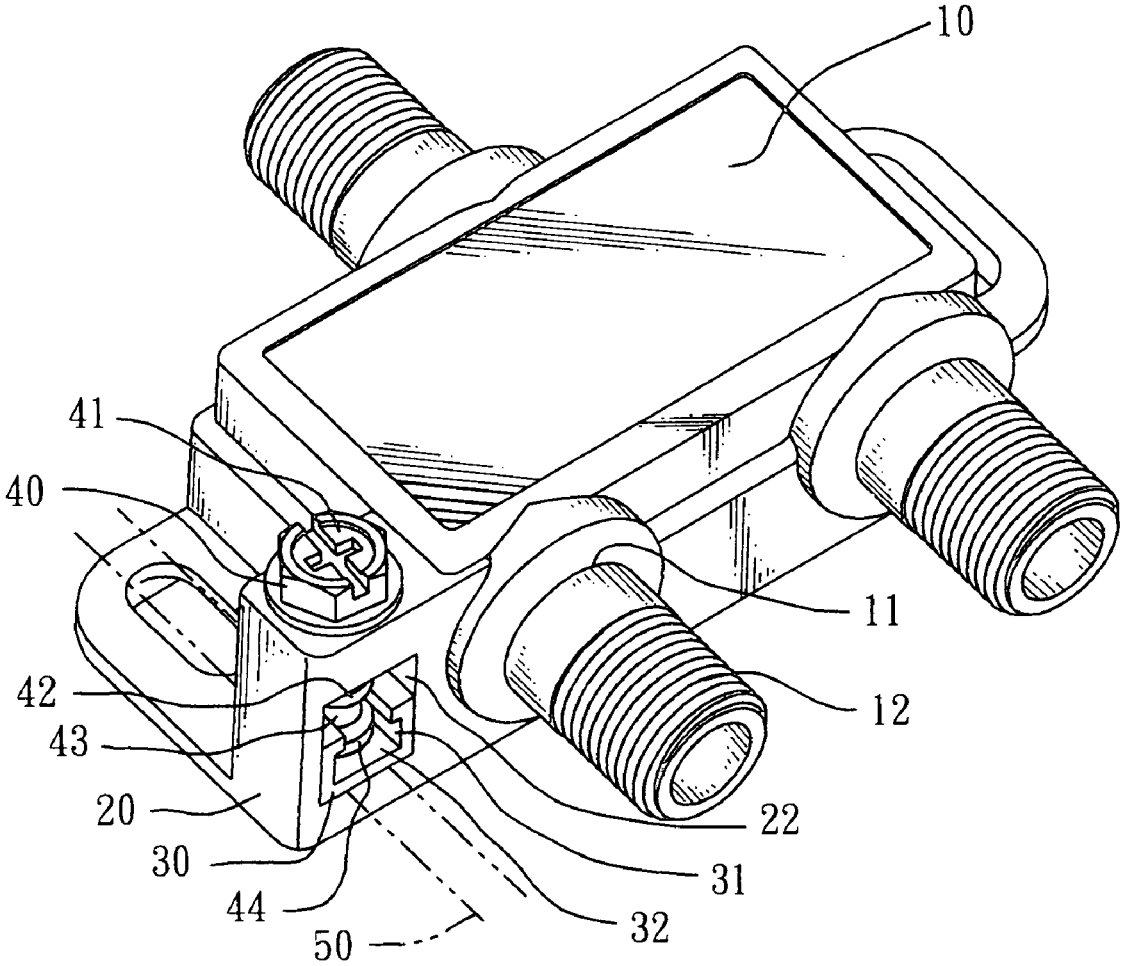
FIG. 3(*a*) is a front perspective view illustrating the radial connecting device for wire screws in FIG. 2 being associated with a ground wire.
Figure 3B:
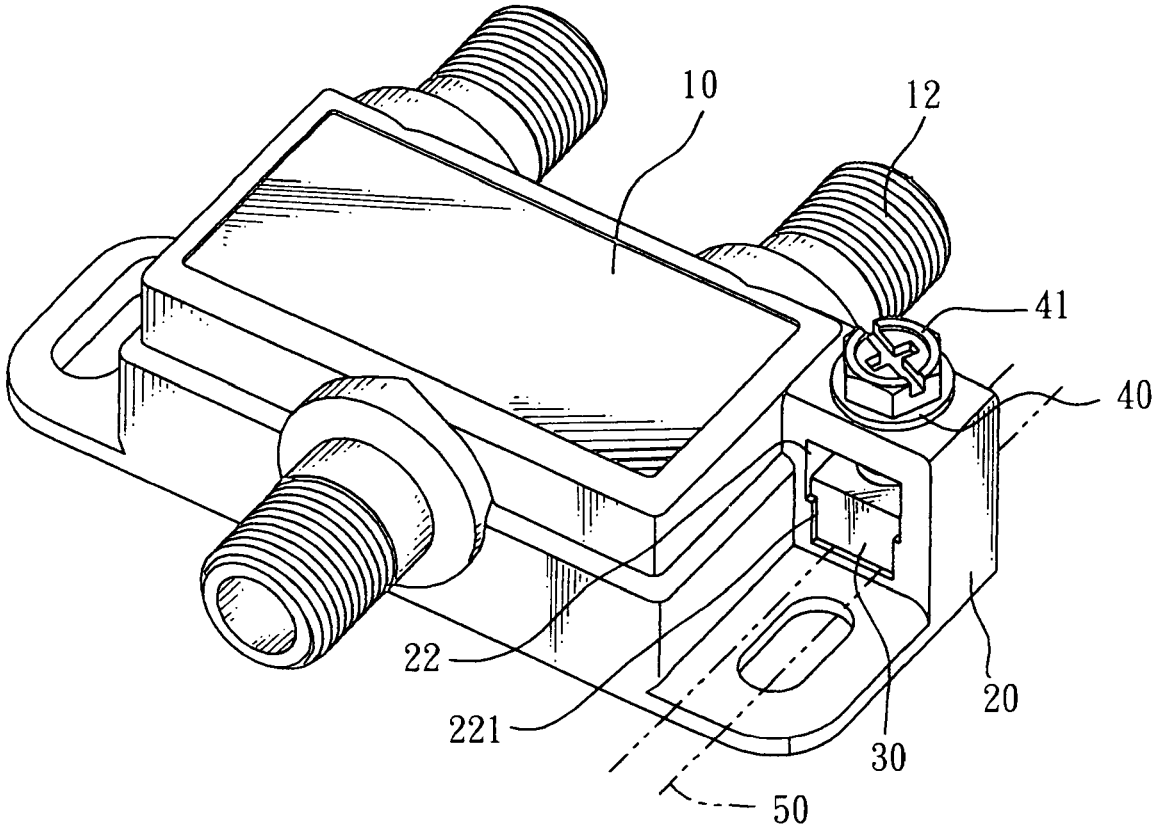

Referring to FIG. 3(*a*), when the ground wire 50 is joined to the radial connecting device of electrical wire screws of the present invention, the press member 30 at the bottom thereof can press the ground wire 50 to the receiving part 22 gradually by way of turning the head 41 of the bolt 40 continuously till the ground wire 50 is fixed in the connecting seat 20 completely and keeps contact with the connecting seat evenly.

Referring to FIG. 3(*b*), a side of the receiving part 22, such as the rear side thereof, has at least a stop part 221 to stop and hold the press member 30 in the receiving part 22.

Beside, the distributor of the present invention further provides a wing part 13 with a fastening hole 131 for the casing 10 being attached to an object, such as a wall or a pole, and wing part 13 is connected to the connecting seat 20. It is preferable that the fastening hole is provided with an elongated shape.

Figure 4:
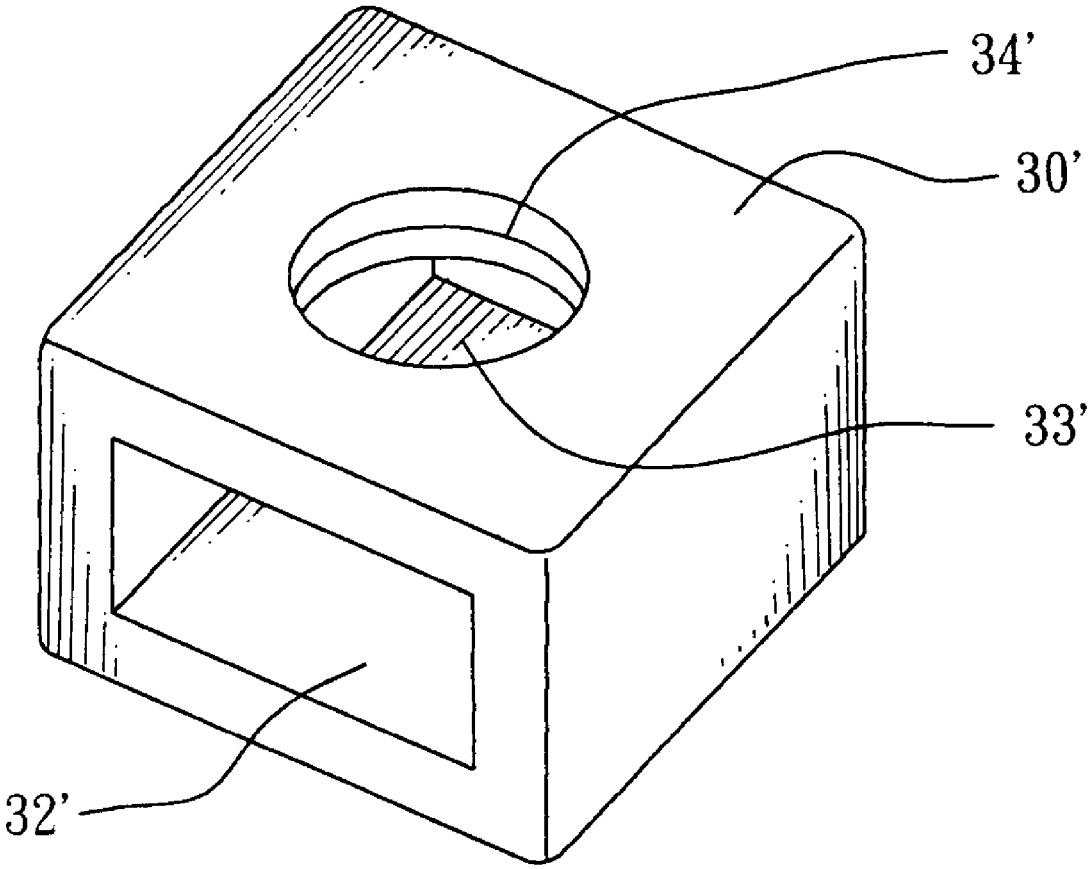
FIG. 4 is a perspective view of a press member in another embodiment of the present invention.

Referring to FIG. 4, another press member 30' can be used instead of the press member 30 shown in FIG. 1. The press member 30' is received in the receiving part 22 and provides a hollow inner chamber 32' with an upper circular hole 33' and inner threads 34' at top end thereof.

Figure 5:
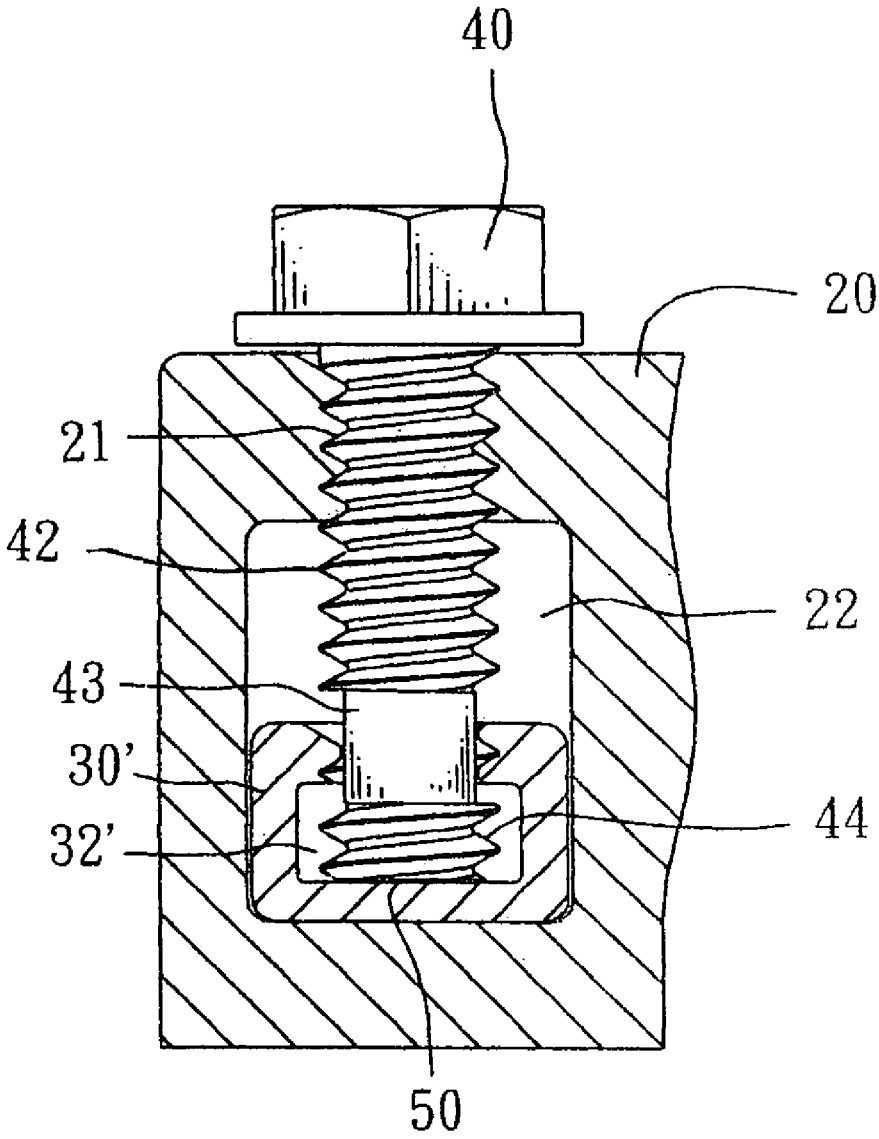
FIG. 5 is a sectional view illustrating the press member 30' of another embodiment according to the present invention being joined to the ground wire.
Figure 6:
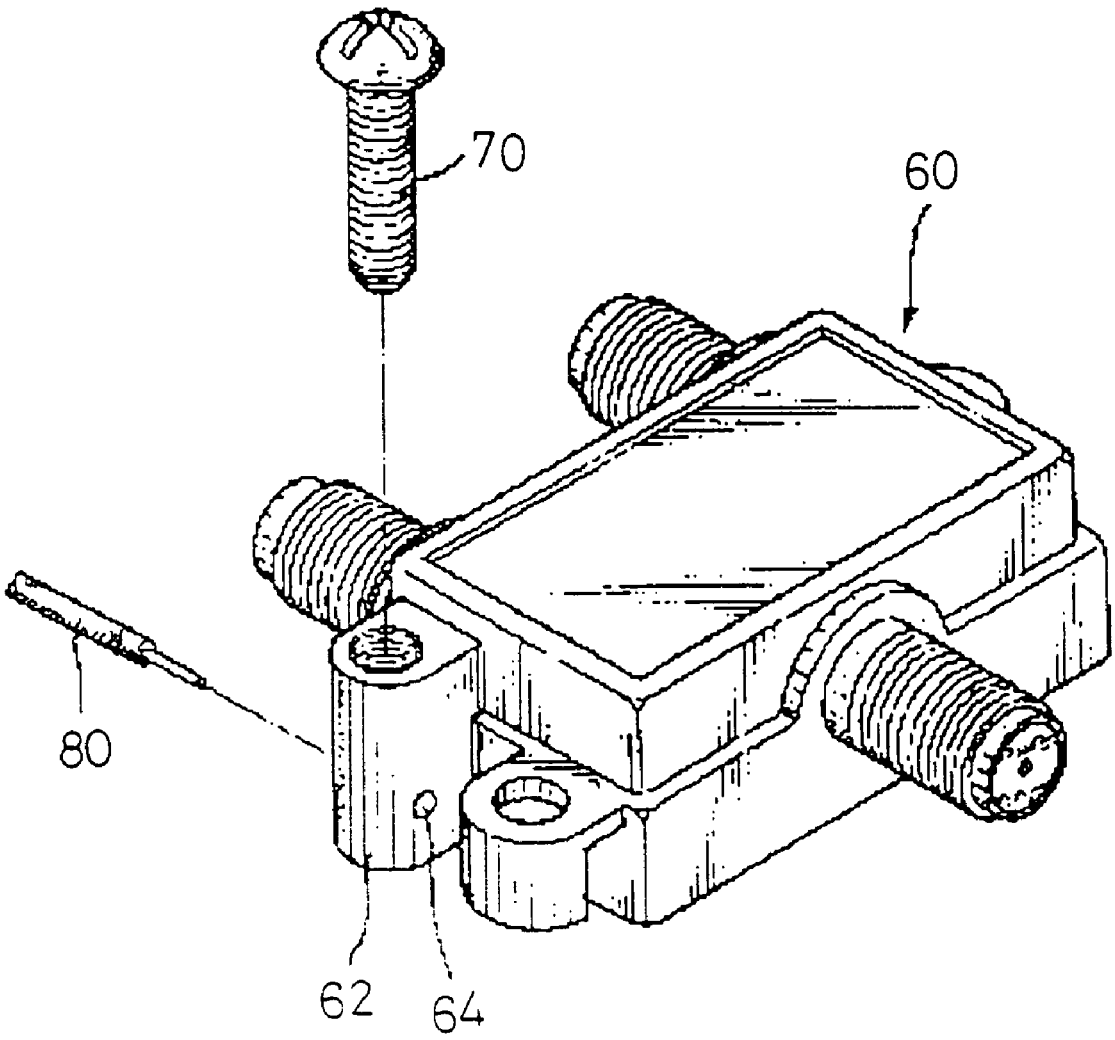
(PRIOR ART) FIG. 6
FIG. 6 is a perspective view of the grounding device of a conventional distributor.
Figure 7:
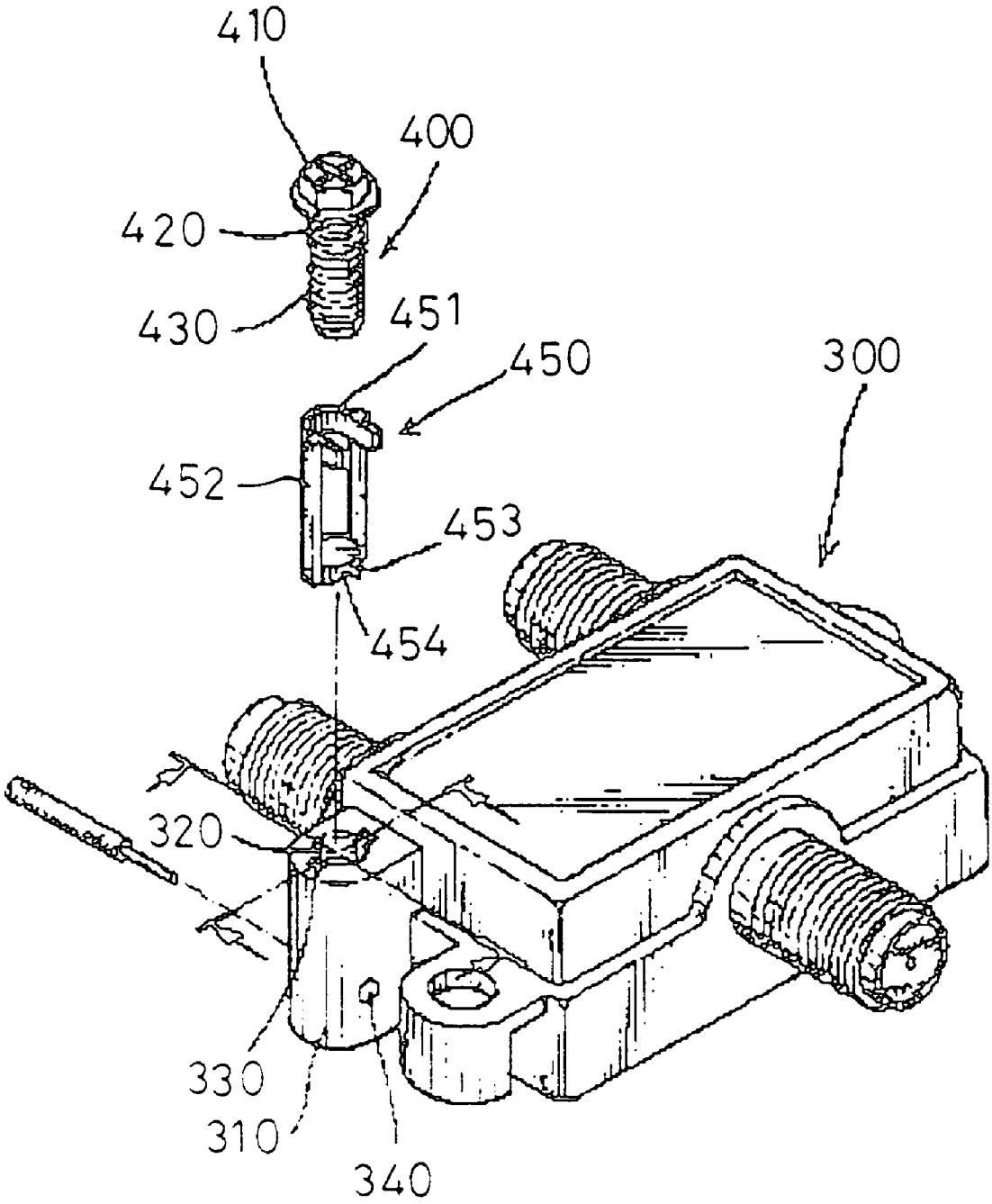
(PRIOR ART) FIG. 7
FIG. 7 is a perspective view of the grounding device disclosed in the Taiwanese Utility Model Application No. 88221149, which has been granted, entitled "GROUNDIG DEVICE OF ELECTRICAL SIGNAL DISTRIBUTOR".

Referring to FIG. 5, it can be seen from the sectional view that the press member 30' is placed in the receiving part 22 and the bolt 40 at the second threaded part 44 engages with the lock hole 21 to enter the receiving part 22 and align with the circular hole 33'. Right at the moment, the first threaded part 42 is going to enter the lock hole 21 and the unthreaded part 43 is going to enter the circular hole 33'. The bolt 40 is turned to allow the first threaded part 42 entering the receiving part 22 and the second threaded part 44 pressing against the press member 30' with an exerting force. In the meantime, the ground wire 50 is arranged under the press member 30' to pass over the press member 30' and the bolt 40 is turned continuously such that the ground wire 50 is fixed in the connecting seat 20 and contacts with the connecting seat evenly. In case of the bolt 40 being turned inversely, the press member 30' can be lifted with a reversed sequence along with the bolt 40.

It is appreciated that the radial connecting device for an electrical wire screw according to the present invention provides advantages such as the ground wire being fixed in the connecting seat and the ground wire contacting with the connecting seat evenly while in use so that the disadvantage of the conventional coaxial cable joint with which the joint is incapable of keeping both functions of water resistant and preventing the coaxial cable from detaching the joint at the same time can be overcome effectively.

While the invention has been described with reference to preferred embodiments thereof, it is to be understood that modifications or variations may be easily made without departing from the spirit of this invention, which is defined by the appended claims.

What is claimed is:

1. A radial screw connecting device for an electrical wire, which is arranged in an electronic apparatus, comprising:

a casing, providing at least an opening for being extended with a joint;

a connecting seat, being disposed at and attached to a side of the casing and providing a lock hole and a receiving part;

a press member, being received in the receiving part and providing a pair of inner arms and an inner chamber; and a bolt, passing through the lock hole, providing a head, a first threaded part, an unthreaded part and a second threaded part, the unthreaded part is located between the first threaded part and the second threaded part, the first threaded part being located in the lock hole, the second threaded part being engaged in the inner chamber;

whereby, while in assembling, a ground wire is inserted into the receiving part below the press member and the ground wire is fixed in the connecting seat and contacts the connecting seat evenly by way of the bolt being turned and pressing a force against the press member and the press member is lifted along with the bolt during the bolt being turned inversely.

2. The radial screw connecting device for an electrical wire as defined in claim 1, wherein the electronic apparatus preferably is a distributor and a connecting seat is preferably is a grounding seat.

3. The radial screw connecting device for an electrical wire as defined in claim 2, wherein the casing and the grounding seat preferably are made of metallic material.

4. The radial screw connecting device for an electrical wire as defined in claim 2, wherein the casing preferably is integrally made with the grounding seat.

5. The radial screw connecting device for an electrical wire as defined in claim 1, wherein the lock hole is provided with internal screw threads.

6. The radial screw connecting device for an electrical wire as defined in claim 1, wherein the receiving part at least has a stop part at a side thereof to limit and holding the press member in the receiving part.

7. The radial screw connecting device for an electrical wire as defined in claim 1, wherein the pair of inner arms is formed of two lateral sides of the inner chamber extending upward and inward for receiving and holding the second screw thread part.

8. The radial screw connecting device for an electrical wire as defined in claim 1, wherein the casing is provided with a wing part at a side thereof and the wing part has a fastening hole for the casing being fixedly attached to an object.

9. The radial screw connecting device for an electrical wire as defined in claim 8, wherein the wing part connects with the connecting seat and the fastening hole preferably is elongated shape.

10. The radial screw connecting device for an electrical wire as defined in claim 1, wherein the lock hole is disposed at the top of the receiving part and the receiving part has a space with an opening at the front and the rear sides thereof.

11. A radial screw connecting device for an electrical wire, which is arranged in an electronic apparatus, comprising:

a casing, providing at least an opening for being extended with a joint;

a connecting seat, being disposed at and attached to a side of the casing and providing a lock hole and a receiving part;

a press member, being received in the receiving part, having a hollow inner chamber, a circular hole with internal threads; and a bolt, passing through the lock hole, providing a head, a first threaded part, an unthreaded part and a second threaded part being engaged in the inner chamber, the unthreaded part is located between the first threaded part and the second threaded part;

whereby, while in assembling, the press member is placed in the receiving member with the second threaded part of the bolt engaging with the lock hole and entering the receiving part in a way of aligning with the circular hole such that the second threaded part enters the inner chamber, the first threaded part enters the lock hole and the unthreaded part enters the circular hole; once the bolt is turned and kept on in a state of turning, the first threaded part enters the receiving part and the second threaded part presses a force against the press member and, at the moment, a ground wire is inserted below the press member and the ground wire is fixed in the connecting seat and contacts the connecting seat evenly by way of the bolt being turned and pressing a force against the press member and the press member is lifted along with the bolt during the bolt being turned inversely.

12. The radial screw connecting device for an electrical wire as defined in claim 11, wherein the electronic apparatus preferably is a distributor and a connecting seat is preferably is a grounding seat.

13. The radial screw connecting device for an electrical wire as defined in claim 12, wherein the casing and the grounding seat preferably are made of metallic material.

14. The radial screw connecting device for an electrical wire as defined in claim 12, wherein the casing preferably is integrally made with the grounding seat.

15. The radial screw connecting device for an electrical wire as defined in claim 11, wherein the lock hole is provided with internal screw threads.

16. The radial screw connecting device for an electrical wire as defined in claim 1, wherein the receiving part at least has a stop part at a side thereof to limit and holding the press member in the receiving part.

17. The radial screw connecting device for an electrical wire as defined in claim 11, wherein the casing is provided with a wing part at a side thereof and the wing part has a fastening hole for the casing being fixedly attached to an object.

18. The radial screw connecting device for an electrical wire as defined in claim 17, wherein the wing part connects with the connecting seat and the fastening hole preferably is elongated shape.

19. The radial screw connecting device for an electrical wire as defined in claim 11, wherein the lock hole is disposed at the top of the receiving part and the receiving part has a space with an opening at the front and the rear sides thereof.

* * * * *